United States Patent [19]

Olivieri

[11] 4,382,616

[45] May 10, 1983

[54] SKATE BLADE GUARD

[75] Inventor: Icaro Olivieri, Westmount, Calif.X

[73] Assignee: Warrington, Inc., Montreal, Canada

[21] Appl. No.: 263,567

[22] Filed: May 21, 1981

[51] Int. Cl.[3] ..... A63C 3/12

[52] U.S. Cl. ..... 280/825; 30/293

[58] Field of Search ..... 280/809, 825; 30/151, 30/286, 293

[56] References Cited

U.S. PATENT DOCUMENTS

| | | | |
|---|---|---|---|
| 1,725,821 | 8/1929 | Nathan | 280/825 |
| 3,135,526 | 6/1964 | Johns | 280/825 |
| 4,324,408 | 4/1982 | Bensette et al. | 280/825 X |

FOREIGN PATENT DOCUMENTS

| | | | |
|---|---|---|---|
| 1028921 | 4/1958 | Fed. Rep. of Germany | 280/825 |

*Primary Examiner*—Joseph F. Peters, Jr.
*Assistant Examiner*—Michael Mar
*Attorney, Agent, or Firm*—Schwartz, Jeffery, Schwaab, Mack, Blumenthal & Koch

[57] ABSTRACT

A skate guard having a protective member and a holding member. The protective member has a longitudinal slot on one side for receiving a skate blade and a plurality of recesses on the opposite side. The holding member has means for snapping into any one recess to detachably connect the holding member to the protective member.

7 Claims, 6 Drawing Figures

Fig. 1
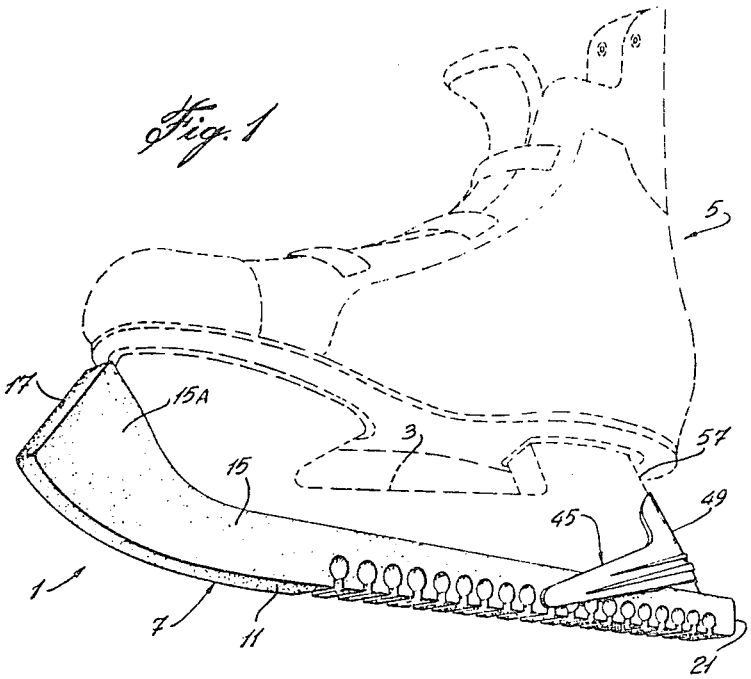
Fig. 2
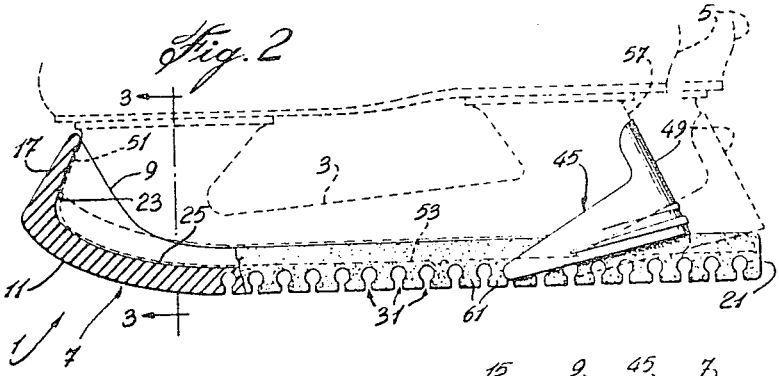
Fig. 3
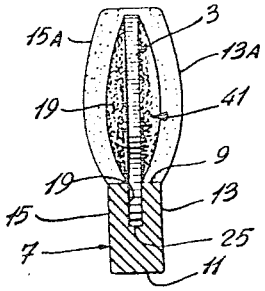
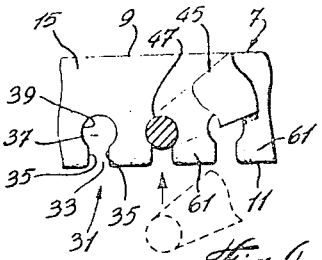
Fig. 4

SKATE BLADE GUARD

BACKGROUND OF THE INVENTION

1. Field of the Invention

This invention is directed toward an improved skate guard.

2. Description of the Prior Art

Skate guards are used to protect the sharp edges of ice skate blades. The skate guards can comprise an elongated, usually flexible, protective member having a slot therein, in which the sharp edge of the blade is inserted to protect it. Usually, the slot in the guard is made in a length to closely fit the blade it is to protect. The close fit helps retain the guard on the blade. However, the guard must be manufactured in different lengths, and this makes it expensive.

It is known to make skate guards which have means to adjust their effective length. Such guards have a protective member with a slot long enough to receive the longest skate blade. The guards also have a holding member which is connected to the protective member to help retain the skate blade in place in the slot. The holding member can be connected to the protective member in one of several different positions depending on the length of the skate blade to be protected. Thus, the effective working length of the skate guard is adjustable.

The holding member is usually detachably fastened to the protective member by fasteners such as a nut and bolt, or screws, passed through one of a series of holes in the protective member. A tool is, therefore, usually required to connect the holding member to the protective member. Also, making the connection outdoors, in cold weather, can be awkward and difficult.

SUMMARY OF THE INVENTION

It is, therefore, the purpose of the present invention to provide an improved, adjustable length, skate guard which is simpler in operation and construction than known skate guards.

In accordance with the present invention, the improved skate guard has a holding member which can be easily snapped in place in one of several positions on the protective member. No separate fasteners, or tools, are required to connect the holding member to the protective member in the desired position. When connected to the protective member, the holding member is securely retained in place. However, it can easily be disconnected to change its position and/or to remove the skate, again without the use of any tools.

The improved skate guard employs a protective member having a blade receiving slot on one side and a plurality of spaced-apart recesses on the other side. The holding member has means thereon for snapping into any one of the recesses to detachably connect the holding member to the protective member. The connection can be simply and quickly made, even outdoors in cold weather. In addition to providing means for detachably connecting the holding member to the protective member, the recesses serve to break up the bottom surface of the protective member to thereby provide a better grip when walking in skates while wearing the guards.

The invention is particularly directed toward an ice skate guard having an elongted protective member with a longitudinal slot in the protective member for receiving the skate blade of an ice skate to be guarded. A plurality of identically-shaped, longitudinally spaced-apart, recesses are provided on the side of the protective member opposite the slot. The recesses are inwardly directed toward the slot. The guard includes a holding member having first means detachably cooperating with any one recess to detachably hold the holding member and protective member together. The holding member also has second means for use in holding the skate blade in the slot when the blade is inserted in the slot, and when the holding member and protective member are held together in a desired position dependent on the length of the skate blade.

BRIEF DESCRIPTION OF THE DRAWINGS

Having thus generally described the nature of the invention, reference will now be made to the accompanying drawings, showing by way of illustration, a preferred embodiment thereof, and in which:

FIG. 1 is a perspective view of the improved skate guard mounted on an ice skate;

FIG. 2 is a side elevation view of the mounted skate guard, seen in partial cross-section;

FIG. 3 is a cross-section view taken along line 3—3 of FIG. 2;

FIG. 4 is a detail view showing the mounting of a skate guard holding member on the skate guard protective member;

DESCRIPTION OF THE PREFERRED EMBODIMENT

Figure 5:
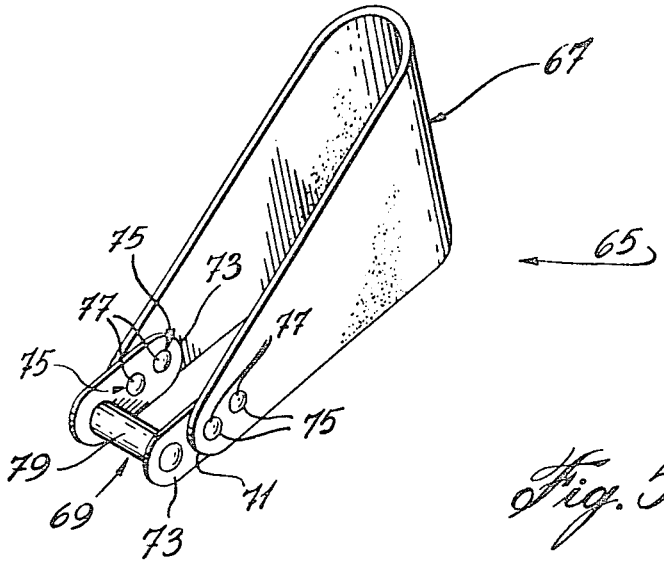
FIG. 5 is a perspective view of another embodiment of the holding member of the skate guard.

The ice skate guard 1 of the present invention is used to protect the sharp skating edge of a blade 3 of an ice skate 5 as shown in FIG. 1. The guard 1 includes an elongated, protective member 7 which can be made from suitable flexible material such as hard rubber. The protective member 7 preferably has a rectangular cross-sectional shape with relatively narrow top and bottom surfaces 9, 11 and relatively wide side surfaces 13, 15. The top and bottom surfaces 9, 11 curve upwardly toward the front end 17 of the protective member 7 with the top surface 9 diverging away from the bottom surface 11 as shown in FIG. 2.

A longitudinally extending slot 19 is provided in the protective member 7 for receiving the bottom portion of the skate blade 3 to be protected. The slot 19 extends downwardly from the center of the top surface 9 of the protective member 7. The slot 19 also extends from the back end 21 of the protective member 7 toward the front end 17 terminating in a front wall 23 just short of the front end 17. The bottom wall 25 of the slot 19 is located approximately midway between the top and bottom surfaces 9, 11 over the major portion of the length of the protective member 7.

A plurality of identically shaped, longitudinally spaced-apart recesses 31 are provided in the protective member 7 on the side of the member opposite the side having the slot 19. The recesses are located in the rear portion of the protective member over one-half to three-quarters of its length. The recesses 31 extend inwardly from the bottom surface 11 of the protective member 7 toward the slot 19, terminating just short of the bottom wall 25 of the slot 19. Preferably, each recess 31 includes a relatively narrow entrance or throat portion 33, defined by a pair of side walls 35 which are parallel to each other and perpendicular to the bottom surface 11. The throat portion 33 opens into an enlarged, part-cylindrically shaped portion 37 defined by a curved wall 39 joining the side walls 35. Both the side and curved walls 35, 39 extend perpendicular to the side surfaces 13, 15 of the protective member 7.

The sides 13, 15 of the protective member 7 are preferably bowed outwardly in the upper, front areas 13*a*, 15*a* of the protective member adjacent the front end 17. The outward bowing of the sides also widens the slot 19 in the region adjacent the front end 17 to provide a pocket 41 for more easily receiving the front end of the skate blade 3 as will be described.

The guard 1 includes a holding member 45. The holding member 45 includes first means detachably cooperating with any one recess 31 on the protective member 7 to detachably hold the holding member 45 and protective member 7 together. These first holding means preferably comprise a cylindrically-shaped rod portion 47 on one end of the holding member 45. This rod portion 47 fits snugly into the enlarged portion 37 of recess 31 when forced through the throat portion 33 of the recess. The rod portion 47 has a width slightly greater than the width of the protective member 7.

The holding member 45 also includes second means for use in holding the blade 3 in the slot 19 when placed therein and when the holding and protective members 45, 7 are detachably connected together. These second holding means preferably comprise a U-shaped strap portion 49 connected at its ends to the ends of the rod portion 47. The holding member 45 preferably is an integral, closed-loop, unit made of suitable flexible, and preferably resilient, material such as soft rubber.

In use, the skate 5 to be protected has its blade 3 inserted into the slot 19 with the front edge 51 of the blade 3 inserted into the pocket 41 of slot 19 and pushed tight up against the front wall 23 of the slot 19. The bottom edge 53 of the blade 3 lies against the bottom wall 25 of the slot 19. The holding member 45 is then looped over the protective member 7 from its rear end 21 and moved forward to place the base of the strap portion 49 against the back edge 57 of the skate blade 3. The rod portion 47 is then drawn forward as far as it will go along the bottom surface 11 of the protective member 7 and is inserted into the nearest recess 31 to securely hold the guard on the skate. The rod portion 47 is pushed through the throat portion 33 of the recess 31 spreading the side walls 35 apart until it is snugly received in the enlarged portion 37 of the recess and held there. The narrow throat portion 33 prevents the rod portion 47 from falling out of the recess 31 once it has been inserted therein. Once the holding member 45 has been inserted into the proper recess 31 for the particular skate to be protected, it remains there until removed. Thus, the holding member 45 cannot easily become lost.

The plurality of longitudinally, spaced-apart recesses allow the position of attachment of the holding member 45 to the protective member 7 to be adjusted along the length of the protective member depending on the length of the skate blade 3 to be protected. Thus, the guard 1 can be used with skates of varying size.

The recesses 31 in the protective member 7 also serve to break up the smooth bottom surface 11 of the guard 1. In effect, a plurality of spaced-apart projections 61 are formed by the recesses 31, which projections 61 provide a better grip when walking in skates while wearing the guards.

Figure 6:
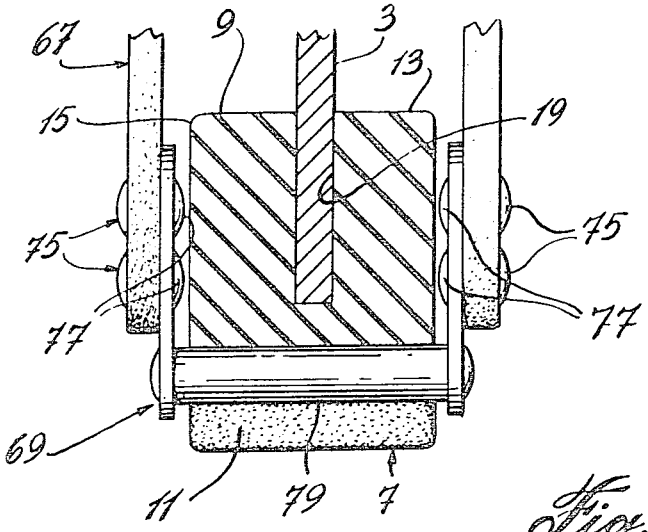
FIG. 6 is a cross-section view showing the holding member of FIG. 5 in use, mounted on the protective member.

In a slightly different embodiment of the invention, shown in FIGS. 5 and 6, the holding member of the skate guard can be modified so as to be assembled from separate components rather than being made in one piece. This holding member 65 would have a separate, U-shaped strap component 67, made as before from suitable resilient material, and a separate U-shaped rod component 69 made from metal or other suitable material. The ends 71 of the arms of the strap component 67 are fastened to the ends 73 of the arms of the rod component by suitable screws or rivets 75. Preferably, a pair of rivets 75 are used on each side of the holding member 65. The heads 77 of the rivets 75 project inwardly from the inside of the arms of the rod component toward each other.

When the holding member 65 is in position, with rod portion 79 of the rod component 69 within a recess 31, and holding a skate blade in place, the rivet heads 77 press against the sides 13, 15 of the protective member 7 to tightly grip the blade 3 in the slot 19 as shown in FIG. 6.

I claim:

1. An ice skate guard having an elongated, protective member, a longitudinal slot in the protective member for receiving the skate blade of an ice skate to be guarded, a plurality of identically-shaped, longitudinally spaced-apart, recesses on the side of the protective member opposite the slot, the recesses being inwardly directed toward the slot, each recess having a narrow throat portion leading to an enlarged portion and a holding member, the holding member having first means detachably cooperating with any one recess to detachably hold the holding member and protective member together, and second means for use in holding the skate blade in the slot when the blade is inserted in the slot, and when the holding member and protective member are held together in a desired position dependent on the length of the skate blade, wherein the first means on the holding member having a portion sized to fit snugly within the enlarged portion of each recess, and one of the holding member and the elongated protective member being made of a material which is resilient such that the portion of the holding portion will pass through the narrow throat portion.

2. An ice skate guard as defined in claim 1, wherein the enlarged portion is partly cylindrical and the first means on the holding member has a cylindrical portion fitting snugly within this enlarged cylindrical portion of each recess.

3. An ice skate guard as claimed in claim 1, wherein the slot in the protective member has a front wall for receiving the front edge of the skate blade.

4. An ice skate guard as claimed in claim 3, wherein the portion of the slot adjacent the front wall is widened to form a pocket to receive the front of the skate blade.

5. A skate blade guard as claimed in claim 1, wherein the first means of the holding member is made integral with the second means of the holding member to form a closed loop, the holding member being made from resilient material.

6. A skate blade guard as claimed in claim 1, wherein the first and second means are made in separate pieces, the second means being made from resilient material, and fastening means joining the first and second means together.

7. A skate blade guard as claimed in claim 1, wherein the first and second means are made in separate pieces, the second means being made from resilient material, and rivets joining the first and second means together, the heads of the rivets on the inner side of the first and second means adapted to press against the sides of the protective member when the holding member is mounted thereon to tightly grip the blade in the slot.

* * * * *